US010781802B2

(12) United States Patent
Rogg

(10) Patent No.: US 10,781,802 B2
(45) Date of Patent: Sep. 22, 2020

(54) PUMPING SYSTEM FOR GASEOUS AND LIQUID MEDIA

(71) Applicant: Werner Rogg, Villingen-Schwenningen (DE)

(72) Inventor: Werner Rogg, Villingen-Schwenningen (DE)

(73) Assignee: Werner Rogg, Villlengen-Schwenningen (DE)

( * ) Notice: Subject to any disclaimer, the term of this patent is extended or adjusted under 35 U.S.C. 154(b) by 775 days.

(21) Appl. No.: 14/979,112

(22) Filed: Dec. 22, 2015

(65) Prior Publication Data

US 2016/0177932 A1 Jun. 23, 2016

(30) Foreign Application Priority Data

Dec. 23, 2014 (DE) ..... 10 2014 119 566

(51) Int. Cl.
*F04B 17/04* (2006.01)
*F04B 35/04* (2006.01)
(Continued)

(52) U.S. Cl.
CPC ..... *F04B 17/044* (2013.01); *F04B 1/02* (2013.01); *F04B 9/117* (2013.01); *F04B 17/04* (2013.01);
(Continued)

(58) Field of Classification Search
CPC ..... F04B 17/04; F04B 23/04; F04B 49/06; F04B 1/02; F04B 17/044; F04B 53/14;
(Continued)

(56) References Cited

U.S. PATENT DOCUMENTS 3,514,228 A 5/1970 Toyoda
7,459,804 B2 * 12/2008 Marwali ..... H02J 3/005 307/127
(Continued)

FOREIGN PATENT DOCUMENTS

DE 19534464 C1 12/1996
DE 602004000339 T2 8/2006
(Continued)

OTHER PUBLICATIONS

Raw machine translation of JPH0783171, Kato et al; "Driving Device of Electromagnetic Pump", Mar. 28, 1995.*
(Continued)

*Primary Examiner* — Charles G Freay
*Assistant Examiner* — Lilya Pekarskaya
(74) *Attorney, Agent, or Firm* — McDonell Boehnen Hulbert & Berghoff LLP

(57) ABSTRACT

The invention relates to a pumping system (1), in particular, for transporting gaseous and/or liquid media having two parallel hydraulically operated oscillating piston pumps (2, 3) whose pistons (8) are moved by means of electromagnetic fields, whereby the electromagnetic fields are generated in field coils (10, L1, L2) by means of half-wave direct current pulse. The invention distinguishes itself by a circuit arrangement (19) that can be connected to an alternating current source having two parallel electric branches that are connected to the field coils (L1, L2) of one of the oscillating pumps (2, 3) respectively, wherein the circuit arrangement (19) is equipped in such a way that the field coils (10, L1, L2) are operated electrically out of phase so that the oscillating piston pumps (2, 3) are operated with a phase displacement of 180°. The invention further relates to a method for operating the pumping system electrically, and a circuit
(Continued)

configuration for the pumping system and accordingly, for executing the method.

6 Claims, 4 Drawing Sheets

(51) Int. Cl.

| | |
|---|---|
| ***F04B 23/06*** | (2006.01) |
| ***F04B 49/06*** | (2006.01) |
| ***F04B 49/04*** | (2006.01) |
| ***F04B 1/02*** | (2006.01) |
| ***F04B 9/117*** | (2006.01) |
| ***F04B 27/00*** | (2006.01) |
| ***F04B 53/14*** | (2006.01) |

(52) U.S. Cl.
CPC ..... *F04B 23/06* (2013.01); *F04B 27/005* (2013.01); *F04B 35/045* (2013.01); *F04B 49/04* (2013.01); *F04B 49/06* (2013.01); *F04B 53/14* (2013.01)

(58) Field of Classification Search
CPC ..... F04B 35/045; F04B 23/06; F04B 9/117; F04B 27/005; F04B 49/04
See application file for complete search history.

(56) References Cited

U.S. PATENT DOCUMENTS

2008/0267798 A1* 10/2008 Liu ..... F04B 35/045 417/416
2011/0020143 A1 1/2011 Van Brunt et al.

FOREIGN PATENT DOCUMENTS

| | | | |
|---|---|---|---|
| EP | 1985857 | A2 | 10/2008 |
| JP | 783171 | A | 3/1995 |
| JP | 2004245119 | A | 9/2004 |

OTHER PUBLICATIONS

Raw machine translation of JP2004245119A, Nakamura et al; "Side-By-Side Installation Operation Method and Side-By-Side Installation Operation Device of Electromagnetic Pump"; Sep. 2, 2004.*
First Office Action issued in European Patent Application No. 152004875 dated May 23, 2016.
Office Action issued in German Patent Application No. 10 2014 119 5663 dated Jun. 4, 2017.
English Translation of Abstract of German Patent Application No. 195 34 464 dated Jun. 26, 2017.
English Translation of Abstract of German Patent Application No. 60 2004 000 339 dated Jun. 26, 2017.

* cited by examiner

PUMPING SYSTEM FOR GASEOUS AND LIQUID MEDIA

CROSS REFERENCE TO RELATED APPLICATIONS

The present application claims the benefit of German Patent Application No. 102014119566.3 filed Dec. 23, 2014 the entire contents of which are incorporated entirely herein by reference.

The invention relates to a pumping system, in particular, for transporting gaseous and/or liquid media such as a fluid, having two hydraulic oscillating piston pumps operating in parallel, the pistons of which are displaced by means of electromagnetic fields, wherein the electromagnetic fields are generated in field coils by means of half-wave direct current pulse. The invention further relates to a method for operating two parallel hydraulic oscillating piston pumps electrically and a circuit arrangement for the pumping system, and accordingly, for executing the method.

Oscillating piston pumps, also called oscillating magnetic piston pumps, are used in many technical fields, in particular, for transporting smaller flow volumes at pressures up to approx. 20 bar. For example, DE 43 08 837 C1 describes a method and a circuit arrangement for controlling the output of an oscillating piston pump electrically. The oscillating piston pump comprises a piston that is loaded by a pressure spring on one side, but is otherwise freely displaceable in a cylinder. The piston is put into motion by the alternating magnetic field of a field coil that is charged via direct current pulse so that upon the excitement of the field coil, the piston is moved against the force of the pressure spring and returns to its initial position upon a release of the pressure spring when no current flows in the field coil and thus no magnetic field is present. The operation of the oscillating piston is achieved thereby, that the field coil has an upstream rectifier or half-wave rectifier element, for example, a diode so that only one half-wave of the AC voltage supply reaches the field coil respectively.

A different oscillating piston pump is described in DE 10 2007 007 297 A1. Together with an anchor body, the piston forms an anchor that is in turn surrounded by a field coil. The anchor body is arranged to work against the force of a spring between two end positions. The application of an alternating current to the field coil leads to the generation of a magnetic flow and the piston is displaced axially. In the first half-wave of the sinusoidal alternating current, the anchor displaces against the load of the spring as the result of the magnetic force, whereby the volume in the compression chamber is increased. Due to the underpressure that is thereby established, an inlet valve opens against the spring load of an inlet valve spring and the fluid is sucked into the compression chamber. During the second half-wave of the sinusoidal alternating current, the anchor moves against the spring load of a second spring element, whereby the volume in the compression chamber is reduced. In this process, an overpressure develops in the compression chamber, whereby the inlet valve closes and an outlet valve opens against the effect of the spring load of the outlet valve spring. Thus, a flow of fluid is produced upon continual movement of the anchor. In particular, that part of a sinusoidal oscillation is described as half-wave—also referred to as half-oscillation—that does not have a change of signs. Over time, the first (e.g. the positive) half-wave and the second (e.g. the negative) half-wave continually alternate.

Connecting hydraulic oscillating piston pumps in parallel is known in prior art in order to thus generate a higher pump output overall. Thereby, a first and a second oscillating piston pump are located parallel to each other between an inlet and an outlet in one pump branch respectively. Thereby, it is problematic that the flow generated hereby is always intermittent. This pulsating flow cannot always be expediently and efficiently used in industrial applications. For this reason, so-called flow rectifiers are installed downstream. However, these lead to an expensive system and cannot always guarantee a uniform flow rate.

Therefore, it is the objective of the present invention to improve the flow rate of oscillating piston pump systems operated in parallel in which the piston displacement is generated by means of half-wave direct current pulse.

This problem is solved by a pump system having the features of claim 1. A pumping system according to the invention provides a circuit arrangement that can be connected or is connected to an alternating current source that comprises two electric branches connected in parallel. The branches are connected to the field coil of one of the oscillating piston pumps respectively so that the field coils or the oscillating piston pumps are connected in parallel to the alternating current source or the alternating voltage source. The circuit arrangement is equipped in such a way that the field coils are operated electrically out of phase, i.e. electrically in phase opposition, so that the oscillating piston pumps are operated with a phase displacement of 180°. In this way, a uniform flow rate can be achieved.

Thereby, the alternating current describes an electric current that changes its direction (polarity) at regular intervals. The same applies to the alternating voltage. Most frequently, the electrical power supply that is provided has sinusoidal alternating current characteristics worldwide. In the European Union, the mains frequency of the public energy supply system stands at 50 Hz.

In this context, electrically in phase opposition can, in particular, be understood to mean, for example, that the piston of the one oscillating piston pump is in a state during which it is pulled back completely due to the magnetic field induced by the field coil, it is thus, for example, in the maximum return position during the suction process while simultaneously, the piston of the other oscillating piston pump is in a completely extended condition. This means that the back and forth movements of the pistons occur at a phase displacement of 180° on an axis of time. According to the invention, the positive half-wave of the alternating current with sinusoidal characteristics can be used to apply current to the field coil of one oscillating piston pump, while the negative half-wave of the alternating current is used to apply current to the field coil of the other oscillating piston pump. By utilizing the behavior of alternating current, the operation of the oscillating piston pumps is clocked efficiently in an easy way. The mechanical interoperation in the case of a flow rate—parallel connection of piston pumps with phase-displaced hydraulic operation—leads to an additional rise in pressure as a consequence of a developing flow overlay.

In this context in particular, operated hydraulically in parallel can mean that the oscillating piston pumps are arranged in branches that are connected hydraulically in parallel and can have a common inlet and a common outlet.

It is particularly practical and advantageous when in the first branch and in the second branch a rectifier element is provided respectively connected in series to the corresponding field coil, such as a rectifier diode, whereby the rectifier elements are poled opposite. This means that the rectifier elements are initially arranged in parallel, but relative to the flow direction and reverse direction they are arranged in such a way, that the rectifier elements are connected antiparallel. Thereby, the first rectifier element can be connected in the flow direction and the second rectifier element in the reverse direction relative to the direction of flow.

In this way, the first half-wave of the mains current can be used effectively to apply current to the field coil of the one oscillating piston pump and the second half-wave can be used effectively to apply current to the field coil of the other oscillating piston pump. Respectively, the rectifier elements let only one half-wave of the alternating current through, so that a pulsating direct current with interruptions results at each individual diode. This leads to phase-displaced excitement of the field coils and contributes to a continuous and higher level of flow. Further, the antiparallel electrical switching achieves an efficient rectified flow of the transported medium.

A further embodiment of the invention provides that the circuit arrangement has a first connection for connecting to a first AC connection of the AC source, for example, a first pole or a first AC power line and a second connection for connecting to a second AC connection of the AC source, e.g. a second pole or a second AC power line, and that the first connection is connected by a first rectifier element with an electric inlet of the field coil of the first oscillating piston pump and directly with an electric outlet of the field coil of the second oscillating piston pump, and that the second connection is connected by a second rectifier element with an electric inlet of the field coil of the second oscillating piston pump and directly with an electric outlet of the field coil of the first oscillating piston pump.

In this way, a first AC power line of a mains supply that is associated with a first pole can be connected with the inlet of the field coil of the first oscillating piston pump by a preferably integrated half-wave rectifying (diode) of the oscillating piston pump, while simultaneously, the first AC power line is connected in parallel with the outlet of the field coil of the second oscillating piston pump, while no half-wave rectification is provided between the outlet of the field coil of the second oscillating piston pump and the first AC power line. In contrast, the second AC power line of the mains supply that is associated with a second pole can be connected with the inlet of the field coil of the second oscillating piston pump by a preferably integrated half-wave rectifying (diode) of the oscillating piston pump, while simultaneously the second AC power supply line is connected in parallel with the outlet of the field coil of the first oscillating piston pump, while no half-wave rectification is provided between the outlet of the field coil of the first oscillating piston pump and the second AC power line.

According to the invention, the first and the second alternating current connections can also be interchanged. This means that the circuitry can also be operated in reverse order. Thus, the first AC power line can be associated with a first polarity of the mains connection and the second AC power line with the other polarity or the other way around. This makes the system particularly safe.

According to a further embodiment of the invention, at least one check valve is provided in the hydraulic system. Check valves can, for example, be provided in the common cycle or in the hydraulic branches.

However, it is particularly preferred when in each of the hydraulic branches in which the oscillating piston pumps are arranged, at least one check valve is provided. However, it has been shown to be particularly advantageous when in at least in one, preferably in each of the hydraulic branches, several serially operated check valves are provided. Therefore, a preferred embodiment provides that the oscillating piston pumps are located in parallel hydraulic branches, whereby in the hydraulic branches several check valves are provided in series and accordingly, serially operated. Preferably, the check valves are located in each of the hydraulic branches in the direction of the flow of the medium behind the respective oscillating piston pump. The check valves can, at least sometimes, also be integrated into the oscillating piston pumps.

Further, it has been shown to be structurally advantageous, when the check valve has a valve closure element, whereby the valve closure element is designed spherical or plate-shaped.

According to the invention, the oscillating piston pumps can comprise a pressure piston that is mounted on a central restore spring or return spring. But the design of the pressure piston can also include a spring on both sides respectively. Regardless of that, the oscillating piston pump is designed in such a way that the piston returns to an initial position when the voltage supply to the field coil is interrupted. For this, one or several return springs can be provided. The design of the springs must be adapted to the required rate of flow and pressure. This also applies to the output of the field coils.

Preferably, the pressure piston is provided with a central bore and at least one transverse bore in steps.

The problem on which the invention is based is further solved by a method for the electric operation of two hydraulic oscillating piston pumps operating in parallel, in particular, in a pumping system described herein, whereby the method provides that the field coils are operated electrically out of phase, i.e. electrically in phase opposition, so that the oscillating piston pumps are operated with a phase displacement of 180°. In particular, this can be realized by means of the steps described herein.

One embodiment of the method according to the invention provides that the field coils of the first and the second oscillating piston pump are connected in parallel to an AC source and that the first half-wave of the alternating current is used to supply current to the field coil of one of the oscillating piston pumps and the second half-wave of the alternating current is used to supply current to the field coil of the other oscillating piston pump. As has already been explained, by means of these steps, the oscillating piston pumps can be controlled efficiently.

It is particularly practical and advantageous when the first half-wave is the positive half-wave and the second half-wave is the negative half-wave of the alternating current. However, it is also possible that the first half-wave is the negative half-wave and the second half-wave is the positive half-wave of the alternating current from the same AC source.

A further embodiment of the method according to the invention provides that a first AC connection of the AC source is connected via a first rectifier element with an electric inlet of the field coil of the first oscillating piston pump and directly with an electric outlet of the field coil of the second oscillating piston pump; and that a second AC connection of the AC source is connected via a second rectifier element with an electric inlet of the field coil of the second oscillating piston pump and directly with an electric outlet of the field coil of the first oscillating piston pump.

Beyond that, the problem on which the invention is based is solved by a circuit arrangement for a pumping system described herein and/or for executing the method described herein, whereby the circuit arrangement has the features that were explained relative to the pumping system. In particular, the circuit arrangement can be integrated into a device having a pumping system and have connections by means of which the circuit arrangement can be connected with the power mains. Of course, the circuit arrangement can also be implemented directly, which is particularly advantageous for industrial applications. In this case, the field coils and the diodes are connected to the current source directly and the circuit arrangement does not have any special interconnections or connections.

For example, the circuit arrangement can be constructed consisting of two electric branches that are connected in parallel that are respectively connected to the field coil of one of the oscillating piston pumps. The branches are connected in parallel to an AC source (e.g. a 50 Hz-AC mains connection) or an AC voltage source so that the oscillating piston pumps are connected electrically in parallel to the AC source via the circuit arrangement. The circuit arrangement is equipped in such a way that the field coils are operated electrically out of phase, i.e. electrically in phase opposition, so that the oscillating piston pumps are operated with a phase displacement of 180°.

According to the invention, the circuit arrangement can be structured in such a way that in the first branch and in the second branch a rectifier element is provided respectively connected in series to the corresponding field coil, whereby the rectifier element of the first branch and the rectifier element of the second branch are poled opposite. In this way, the circuitry can be operated in one direction and in the other direction.

It is particularly advantageous when a first AC connection of the AC source is connected via a first rectifier element with an electric inlet of the field coil of the first oscillating piston pump and directly with an electric outlet of the field coil of the second oscillating piston pump and a second AC connection of the AC source is connected via a second rectifier element with an electric inlet of the field coil of the second oscillating piston pump and directly with an electric outlet of the field coil of the first oscillating piston pump.

The circuit arrangement can also have a first connection for connecting to a first AC connection of the AC source and a second connection for connecting to a second AC connection of the AC source. The first connection can be connected via a first rectifier element with an electric inlet of the field coil of the first oscillating piston pump and directly with an electric outlet of the field coil of the second oscillating piston pump. The second connection can be connected via a second rectifier element with an electric inlet of the field coil of the second oscillating piston pump and directly with the electric outlet of the field coil of the first oscillating piston pump.

As a result of the special circuits of the pumps in the manner of a full wave circuit, a uniform rate of flow is achieved. In this way, using simple steps (antiparallel electric circuits), an efficient unidirectional flow can be achieved at higher levels of flow and pressure by operating the oscillating piston pumps in a phase-displaced manner.

The circuit arrangement or the circuit arrangement of the pumping system according to the invention can have a control unit. The control unit can have a manual and/or an automatic changeover switch.

Certified translation, please see attached translators declaration dated Dec. 11, 2015. Hereby, the pumping system provides for a circuit arrangement that can be connected or is connected to an alternating current source that has two electric branches connected in parallel. The branches are connected to the field coil of one of the oscillating piston pumps respectively so that the field coils or the oscillating piston pumps are connected to the AC source or the alternating voltage source in parallel, and the circuit arrangement is equipped in such a way that the field coils can be operated electrically out of phase, i.e. electrically in phase opposition. The circuit arrangement is equipped in such a way that it can be switched from a 180° phase-displaced operation of the oscillating piston pumps to an operation that is electrically in-phase. The circuit arrangement is equipped in such a way that the field coils can be operated alternatively electrically out of phase so that the oscillating piston pumps are operated with a phase displacement of 180°, or can be operated electrically in-phase so that the oscillating piston pumps can be operated in-phase, i.e. without phase displacement.

As the result of the in-phase operation of the pumps, a pulsed stream of the medium is generated that can be used to clean clogged lines. The switching between the operating modes can be performed manually by using a switch. But it has also been shown to be advantageous when a sensor is provided for measuring the pressure in at least one section of the line of the pumping system or in a section of the line of a line system that is connected to the pumping system. The circuit arrangement can be equipped in such a way that the operating mode of the pumping system is switched from a 180° phase-displaced operation of the pumps to an in-phase operation of the pumps as soon as the pressure in the line, for example, due to clogging, exceeds a threshold value. Ideally, the operating mode of the pumping system is again switched to a 180° phase-displaced operation of the pumps when the clogging has been removed and the pressure has once again dropped below the threshold value.

For phase-displaced operation, the control unit can easily be integrated into the circuit arrangement described herein or into the circuit arrangement of the pumping system described herein. Thus, the circuit arrangement has a first connection for connecting to a first AC connection of the AC source and a second connection for connecting to a second AC connection of the AC source, whereby the control unit can be switched between at least two switching states. The control unit is designed in such a way that in a first switching state, the first connection is connected via a first rectifier element with an electric inlet of the field coil of the first oscillating piston pump and directly with an electric outlet of the field coil of the second oscillating piston pump and that the second connection is connected via a second rectifier element with an electric inlet of the field coil of the second oscillating piston pump and directly with the electric outlet of the field coil of the first oscillating piston pump. In a second switching state, one of the first and the second connection is connected via the first rectifier element with the electric inlet of the field coil of the first oscillating piston pump and via the second rectifier element with the electric inlet of the field coil of the second oscillating piston pump, whereby the other one of the first and the second connection is connected directly with the respective electric outlet of the two field coils, i.e. with the outlet of the first field coil and with the outlet of the second field coil. The reverse directions and the flow directions of the first and the second rectifier element are thus switched to the same phase and the two field coils are operated by the same half-wave of the alternating current.

For example, in the second switching state, the first connection can be connected via the first rectifier element with the electric inlet of the field coil of the first oscillating piston pump and via the second rectifier element with the electric inlet of the field coil of the second oscillating piston pump, while the second connection is connected directly with the electric outlet of the field coil of the first oscillating piston pump and directly with the electric outlet of the field coil of the second oscillating piston pump.

It is also possible that in the second switching state, the second connection is connected via the first rectifier element with the electric inlet of the field coil of the first oscillating piston pump and via the second rectifying element with the electric inlet of the field coil of the second oscillating piston pump, while the first connection is connected directly with the electric outlet of the field coil of the first oscillating piston pump and directly with the electric outlet of the field coil of the second oscillating piston pump.

Further features, advantages and application possibilities of the invention also result from the following description of exemplary embodiments and the drawings. Thereby, all features described and/or pictorially illustrated by themselves or in any combination are the subject matter of the invention, regardless of their summary in the claims or their references.

Shown are:

FIGS. 3*a-d* show the phase-displaced excitation of the field coils; and

Figure 4A:
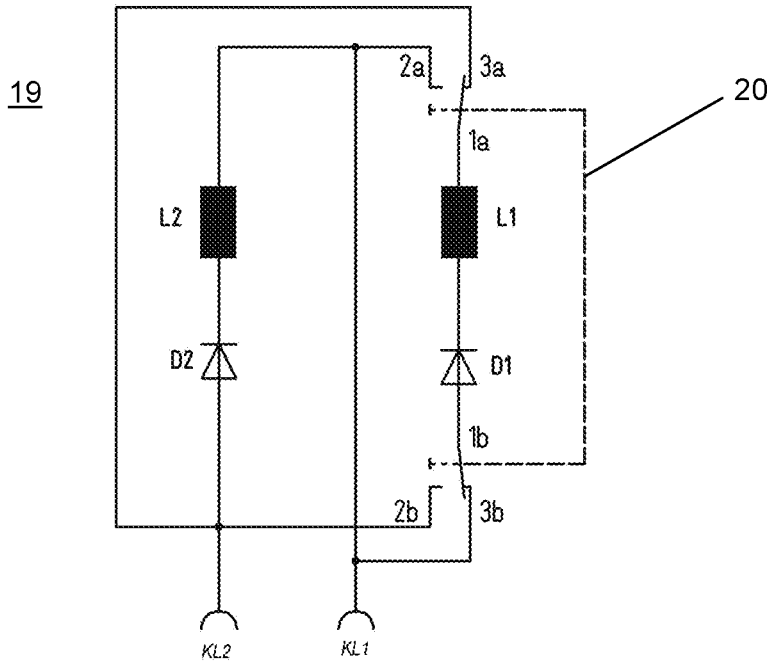

FIGS. 4*a, b* show a circuit arrangement according to a further embodiment of the invention.

Figure 1:
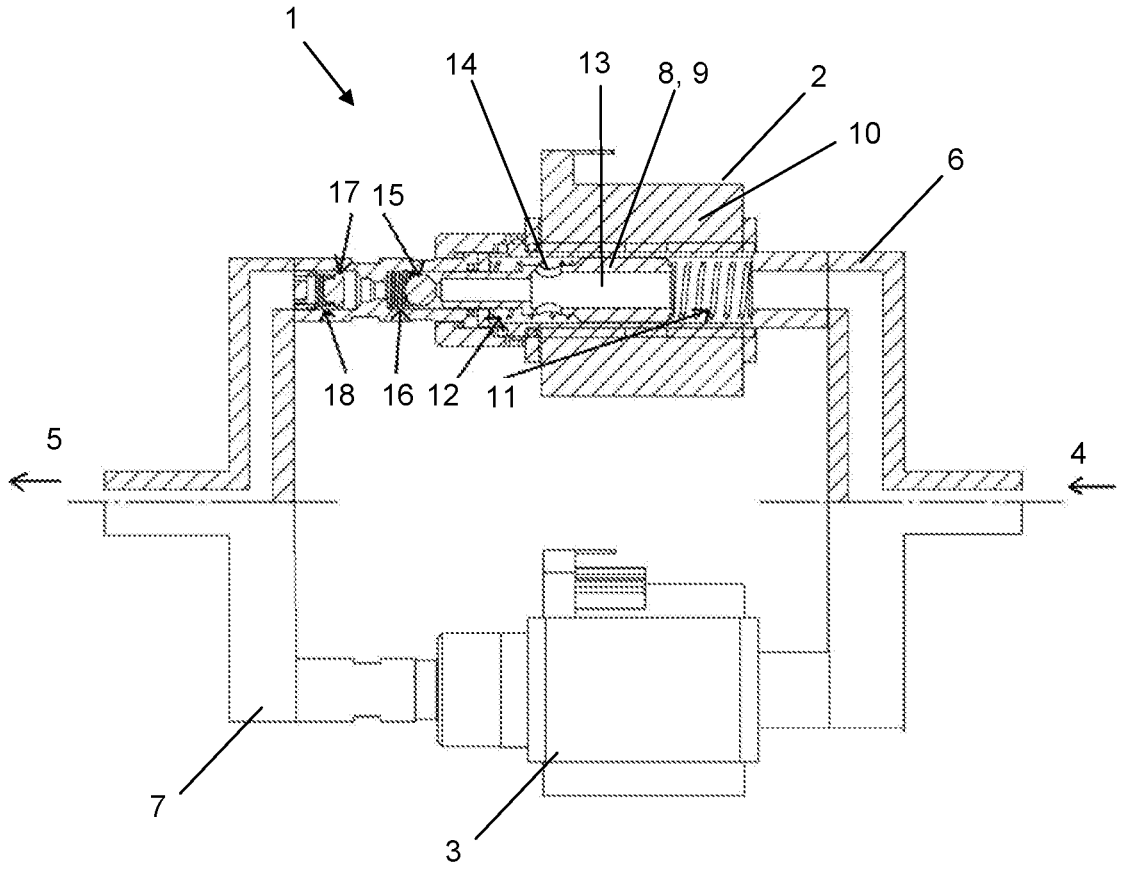
FIG. 1 shows a pumping system according to a first embodiment of the invention.

FIG. 1 shows a pumping system 1 having two hydraulic oscillating piston pumps 2, 3 that are operated connected in parallel between an inlet 4 and an outlet 5 in one pump branch 6, 7 respectively. The upper oscillating piston pump 2 and the upper pump branch 6 are shown in cross section, the lower oscillating piston pump 3 and the lower pump branch 7 are shown in a top view, however, their structure corresponds to that of oscillating piston pump 2 and pump branch 6.

Pumps 2, 3 respectively comprise an axially displaceable piston 8 having an anchor element 9 and a field coil 10. Piston 8 is mounted in a first axial direction at a first return spring 11 (pressure spring) and in the opposite direction at a second return spring 12 (pressure spring).

Piston 8 is provided with a central bore 13 and two transverse bores 14 in stepped manner. A first valve 15 comprises a sphere mounted on a spring 16. A second valve 17 comprises a plate-slider mounted on a spring 16. The valves serve as check valves.

As a result of the back and forth motions of piston 8 and due to the interaction of valves 15, 17 the fluid from inlet 4 is pumped to outlet 5 in spurts. When current is applied to field coil 10, piston 8 displaces axially to the right via the anchor and compresses spring 11. When the supply of current to field coil 10 is interrupted, piston 8 is again displaced to the left due to the force of the compressed spring 11, as a result of which a medium (here a fluid) of the hydraulic system is pressed toward the left. This also applies to the oscillating piston pump 3.

Figure 2:
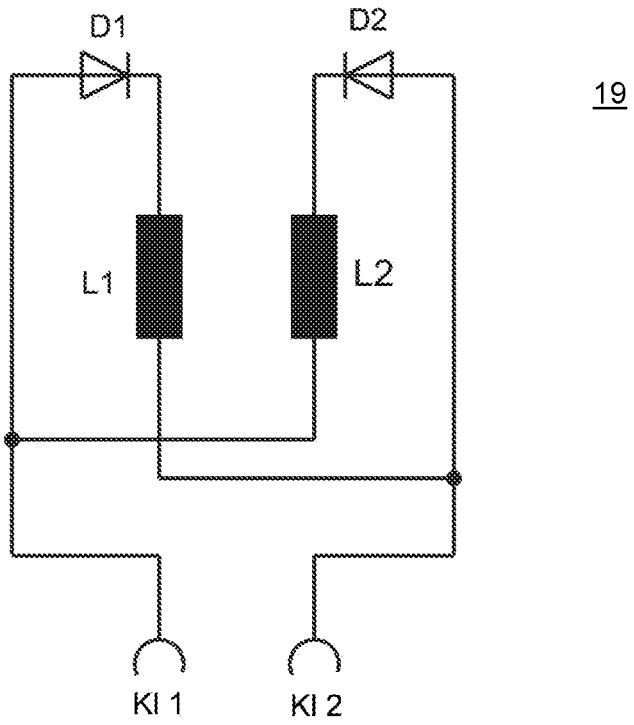
FIG. 2 shows a circuit arrangement according to a first embodiment of the invention.

For the phased excitement of the field coils in oscillating piston pumps 2, 3 a circuit arrangement is provided that is shown in FIG. 2. The circuit arrangement is connected to a 50 Hz AC mains. The AC mains power supply comprises a first mains cable KI1 and a second mains cable KI2 that are poled differently. The AC mains power supply supplies alternating current with sinusoidal characteristics.

L1 identifies field coil 10 (FIG. 1) of the first oscillating piston pump 2. L2 identifies the field coil of the second oscillating piston pump 3. Field coils L1 and L2 are connected to mains cables KI1 and KI2 (AC connections) switched in parallel. Thus, the circuit arrangement comprises two electrical branches that are switched in parallel, whereby each of the branches is connected to one of the field coils L1 and L2.

At its inlet, the first field coil L1 has an integrated rectifier diode D1 so that the first electric branch formed by field coil L1 has a diode D1 connected in series with field coil L1. The first mains cable KI1 is connected with the inlet of field coil L1 of the first oscillating piston pump via the integrated half-wave rectifier D1. Simultaneously, the first mains cable KI1 is connected in parallel with the outlet of the second field coil L2. The outlet of the second field coil L2 does not have an integrated half-wave rectification; this means that the field coil is connected directly with the first mains cable KI1.

At its inlet, the second field coil L2 has an integrated rectifier diode D2 so that the second electrical branch formed by field coil L2 has a diode D2 that is connected in series with field coil L2. The second mains cable KI2 is connected with the inlet of field coil L2 of the second oscillating piston pump via the integrated half-wave rectification D2. Simultaneously, the second mains cable KI2 is connected in parallel with the outlet of the first field coil L1. The outlet of the first field coil L1 does not have an integrated half-wave rectification which means that the field coil L1 is connected directly with the second mains cable KI2.

Diodes D1 and D2 are switched antiparallel relative to mains cables KI1 and KI2, or poled opposite. This means that the return direction and the flow direction are oriented opposite. If the current is coming from KI1, D1 is in the flow direction and D2 in the reverse direction. In contrast, if the current comes from KI2, it is reversed.

Figure 3A:
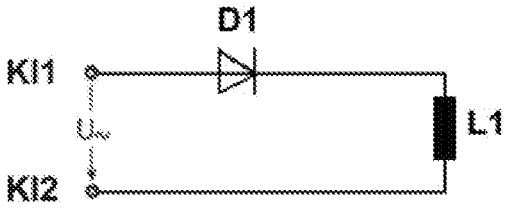
Figure 3B:
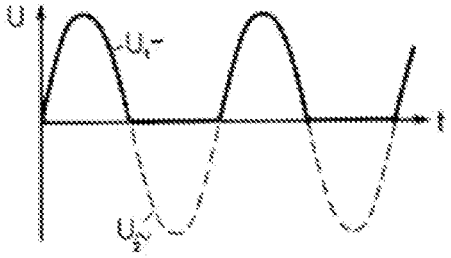
Figure 3C:
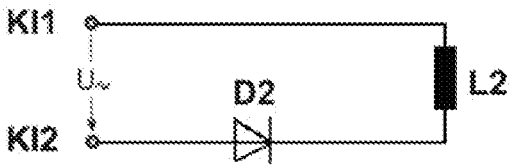
Figure 3D:
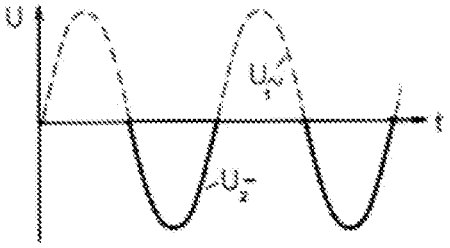

FIGS. 3*a* through 3*d* show the alternating excitement of the first and second field coils L1 and L2. FIG. 3*a* shows the first branch of field coil L1 that is connected with the mains having Diode D1 connected in series. FIG. 3*b* shows the voltage characteristic U of sinusoidal alternating current—correspondingly, the characteristic voltage curve trails phase-displaced—at the outlet of diode D1. FIG. 3*c* shows the second branch of field coil L2 that is connected to the mains having diode D2 connected in series. FIG. 3*d* shows the voltage curve U of sinusoidal alternating current at the outlet of diode D2. Due to the antiparallel arrangement of diodes D1 and D2, diode D1 permits only the positive half-waves U1 of the supply voltage—and thus the current—to flow through field coil L1. In contrast, diode D2 permits only the negative half-waves U2 of the voltage supply to flow through field coil L2. Consequently, the mains current or the mains voltage is divided phased between field coil L1 and L2. During the phases of the positive half-waves the piston in the first oscillating piston pump is displaced due to field coil L1, whereas the piston is reset by the spring in the phase of the negative half-waves. In the other oscillating piston pump it is precisely the reverse. While in the phases of the positive half-waves, the piston in the second oscillating piston pump is reset by the spring, whereas the piston in the phase of the negative half-waves is displaced by field coil L2.

The circuit shown in FIG. 2 can also take place the other way around by interchanging KI1 and KI2. In this case, the field coil L1 is supplied with current only during the phases of the negative half-waves and the field coil L2 is supplied with current only during the phases of the positive half-waves.

Figure 4B:
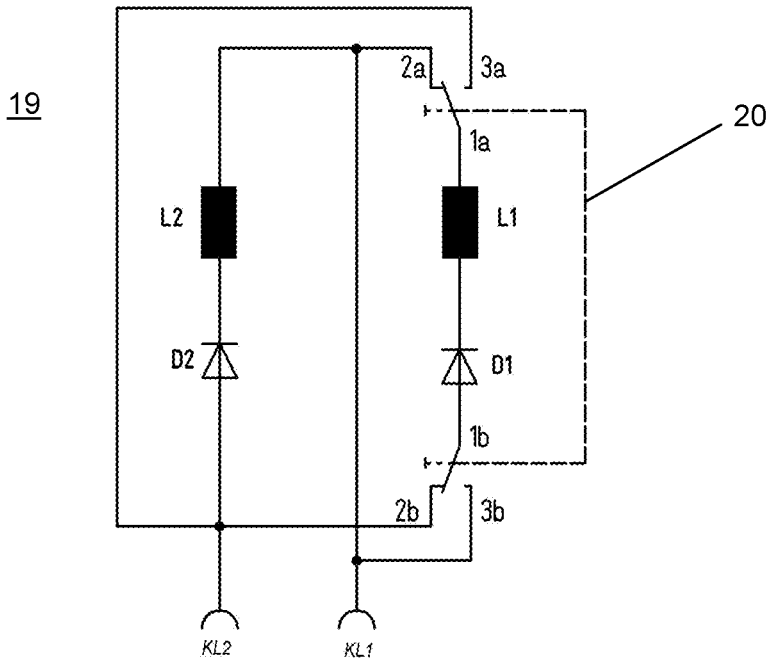

The circuit arrangement shown in FIGS. 4*a* and 4*b* shows an integrated control unit 20. By means of control unit 20, the operating condition of the pumping system can be switched from a phase-displaced operation to an in-phase operation in which the pumps run synchronously. Here, circuit arrangement 19 is likewise connected to a 50 Hz mains power supply by a first power cable KI1 and a second power cable KI2 that are poled differently. The AC power mains supplies alternating current with sinusoidal characteristics.

Components L1, L2, D1 and D2 correspond to the components shown in FIG. 2.

The first field coil L1 has an integrated rectifier diode D1 at its inlet and the second field coil L2 has rectifier diode D2 at its inlet.

Control unit 20 can be switched between two states. In a first state that is shown in FIG. 4*a*, control unit 20 connects the first power cable KI1 with the inlet of field coil L1 of the first oscillating piston pump via integrated half-wave rectifier D1 (connection 1*b*-3*b*) and the outlet of field coil L1 directly with KI2 (connection 1*a*-3*a*). The outlet of field coil L2 is connected directly with KI1. Simultaneously, the second power cable KI2 is connected with the inlet of field coil L2 of the second oscillating piston pump via integrated half-wave rectification D2, and the second power cable KI2 is connected in parallel with the outlet of the first field coil L1.

In the first switching state, the circuitry of the components corresponds to the configuration shown in FIG. 2. The second switching state is shown in FIG. 4*b*. By switching the control unit 20, the second power cable connection KI2 is separated from the outlet of the first field coil L1 and the outlet of the first field coil L1 is connected directly with the first power cable connection KI1 (connection 1*a*-2*a*). Further, the connection between the half-wave rectification D1 and the mains connection KI1 is separated and the half-wave rectification D1 is connected with mains connection KI2 (connection 1*b*-2*b*). The connection of the second field coil L2 to mains connections KI1 and KI2 remains unchanged. Due to the switching, first field coil L1 is connected to mains connections KI1 and KI2 just like the second field coil.

In the first switching state (FIG. 4*a*) of control unit 20, the diodes D1 and D2 are switched antiparallel relative to power cables KI1 and KI2, and accordingly poled opposite. This means that the reverse direction and the flow direction are oriented opposite. If the current is flowing coming from KI1, D1 is in flow direction and D2 in reverse direction. In contrast, if the current is flowing coming from KI2, it is reversed. Thereby, the phase-displaced operation is generated.

In the second switching state (FIG. 4*b*) of control unit 20, diodes D1 and D2—relative to power cables KI1 and KI2—are connected poled in the same directions. This means that the reverse direction and the flow direction are oriented in the same direction. If the current is flowing coming from KI1, D1 and D2 are in the reverse direction. If the current is flowing coming from KI2, it is the reverse.

As the result, the in-phase operation is generated and the hydraulic pumps connected in parallel generate a pulsed stream of the gaseous or liquid medium.

REFERENCE NUMBERS

1 pumping system
2 oscillating piston pump
3 oscillating piston pump
4 inlet
5 outlet
6 pump branch
7 pump branch
8 piston
9 anchor
10 field coil
11 return spring
12 spring
13 central bore
14 transverse bore
15 valve
16 spring
17 valve
18 spring
19 circuit arrangement
20 control unit
KI1 first AC power line
KI2 second AC power line
L1 first field coil
L2 second field coil
D1 first rectifier diode
D2 second rectifier diode

What is claimed is:

1. A pumping system for transporting gaseous and/or liquid media, the pumping system comprising:

a first hydraulically operated oscillating piston pump comprising a first field coil and a first piston that is movable via a first electromagnetic field of the first field coil resulting from a first half-wave direct current pulse;

a second hydraulically operated oscillating piston pump comprising a second field coil and a second piston that is movable via a second electromagnetic field of the second field coil resulting from a second half-wave direct current pulse;

a circuit arrangement that is configured to be connected to an alternating current source, the circuit arrangement having a first electric branch and a second electric branch, the first electric branch being connected with the first field coil and the second electric branch being connected with the second field coil; and a control unit, wherein the control unit and the circuit arrangement are configured to facilitate operation of the first hydraulically operated oscillating piston pump and the second hydraulically operated oscillating piston pump in a first mode in which the first hydraulically operated oscillating piston pump and the second hydraulically operated oscillating piston pump operate electrically out of phase and alternatively in a second mode in which the first hydraulically operated oscillating piston pump and the second hydraulically operated oscillating piston pump operate electrically in phase, wherein in a first switching state of the circuit arrangement corresponding to the first mode, a first connection of the alternating current source is connected via a first rectifier element with a first electric inlet of the first field coil and directly with a second electric outlet of the second field coil and a second connection of the alternating current source is connected via a second rectifier element with a second electric inlet of the second field coil and directly with a first electric outlet of the first field coil, and wherein in a second switching state of the circuit arrangement corresponding to the second mode, the second connection is connected via the first rectifier element with the first electric inlet of the first field coil and via the second rectifier element with the second electric inlet of the second field coil, wherein the first connection is connected directly with the first electric outlet of the first field coil and the second electric outlet of the second field coil.

2. The pumping system as recited in claim 1, wherein, in the first electric branch, the first rectifier element is provided in series with the first field coil, and, in the second electric branch the second rectifier element is provided in series with the second field coil.

3. The pumping system as recited in claim 1, further comprising:

a first hydraulic branch comprising the first hydraulically operated oscillating piston pump and a first check value; and a second hydraulic branch comprising the second hydraulically operated oscillating piston pump and a second check valve.

4. The pumping system as recited in claim 3, wherein the first check valve has a valve-locking element and the second check valve has a valve-locking element, wherein each valve-locking element is formed spherical or plate shaped.

5. The pumping system as recited in claim 1, wherein the first piston of the first hydraulically operated oscillating piston pump and the second piston of the second hydraulically operated oscillating piston pump are pressure pistons that are respectively mounted on central return springs.

6. A method of operating the pumping system of claim 1, the method comprising:

the control unit placing the circuit arrangement in the first switching state; and the control unit placing the circuit arrangement in the second switching state.

* * * * *